US008836315B2

(12) United States Patent
Satoh et al.

(10) Patent No.: US 8,836,315 B2
(45) Date of Patent: Sep. 16, 2014

(54) RESISTANCE SIGNAL GENERATING CIRCUIT WITH N TEMPERATURE CHARACTERISTIC ADJUSTING ELEMENTS

(75) Inventors: Yuji Satoh, Chiba (JP); Shouhei Kousai, Kanagawa (JP); Hiroyuki Kobayashi, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 255 days.

(21) Appl. No.: 13/423,794

(22) Filed: Mar. 19, 2012

(65) Prior Publication Data

US 2013/0057246 A1 Mar. 7, 2013

(30) Foreign Application Priority Data

Sep. 2, 2011 (JP) ..... 2011-191164

(51) Int. Cl.
*G05F 3/16* (2006.01)
*G05F 3/20* (2006.01)
*G05F 3/30* (2006.01)

(52) U.S. Cl.
CPC ..... *G05F 3/30* (2013.01)
USPC ..... 323/316

(58) Field of Classification Search
USPC ..... 323/311–316
See application file for complete search history.

(56) References Cited

U.S. PATENT DOCUMENTS

| | | | | |
|---|---|---|---|---|
| 7,737,768 | B2 * | 6/2010 | Byeon | 327/539 |
| 2003/0006747 | A1 * | 1/2003 | Jaussi et al. | 323/315 |
| 2004/0124825 | A1 * | 7/2004 | Marinca | 323/316 |
| 2004/0245975 | A1 * | 12/2004 | Tran et al. | 323/313 |
| 2005/0110476 | A1 * | 5/2005 | Mukherjee et al. | 323/313 |
| 2008/0067996 | A1 * | 3/2008 | Murase | 323/316 |
| 2009/0256623 | A1 | 10/2009 | Tajima | |
| 2010/0134087 | A1 * | 6/2010 | Hwang et al. | 323/313 |
| 2011/0001568 | A1 | 1/2011 | Lin | |
| 2011/0181367 | A1 | 7/2011 | Satoh et al. | |
| 2012/0056609 | A1 | 3/2012 | Satoh | |

FOREIGN PATENT DOCUMENTS

| | | |
|---|---|---|
| JP | 8-279446 | 10/1996 |
| JP | 2000-188305 | 7/2000 |
| JP | 2003-85526 | 3/2003 |
| JP | 2009-157573 | 7/2009 |

OTHER PUBLICATIONS

Hironori Banba, et al., "A CMOS Bandgap Reference Circuit with Sub-1-V Operation", IEEE Journal of Solid-State Circuits, vol. 34, No. 5, May 1999, pp. 670-674.
Office Action issued on Jan. 7, 2014 in the corresponding Japanese Patent Application No. 2011-191164 (with English Translation).

* cited by examiner

*Primary Examiner* — Adolf Berhane
*Assistant Examiner* — Gary Nash
(74) *Attorney, Agent, or Firm* — Oblon, Spivak, McClelland, Maier & Neustadt, L.L.P.

(57) ABSTRACT

According to one embodiment, a reference signal generating circuit includes a first nonlinear element that generates a first reference voltage, a second nonlinear element that generates a second reference voltage, a current controlling circuit that controls a current flowing to the first nonlinear element and a current flowing to the second nonlinear element based on an output voltage of the current controlling circuit itself, and N temperature characteristic adjusting elements (N is an integer of 2 or larger) that individually adjust the temperature characteristics of the output voltage of the current controlling circuit.

11 Claims, 8 Drawing Sheets

R1 INCREASE

R1 DECREASE

RESISTANCE SIGNAL GENERATING CIRCUIT WITH N TEMPERATURE CHARACTERISTIC ADJUSTING ELEMENTS

CROSS-REFERENCE TO RELATED APPLICATIONS

This application is based upon and claims the benefit of priority from Japanese Patent Application No. 2011-191164, filed on Sep. 2, 2011; the entire contents of which are incorporated herein by reference.

FIELD

Embodiments described herein generally relate to reference signal generating circuits.

BACKGROUND

As reference current generating circuits, BGR (band gap reference) circuits are sometimes used in which temperature characteristics are compensated based on a combination of diodes and resistances. In the BGR circuits, the temperature characteristics can be corrected by adjusting the values of parameters for controlling an output current.

DETAILED DESCRIPTION

Reference signal generating circuits according to the present embodiments each includes a first nonlinear element, a second nonlinear element, a current controlling circuit, and N temperature characteristic adjusting elements (N is an integer of 2 or larger). The first nonlinear element generates a first reference voltage. The second nonlinear element generates a second reference voltage. The current controlling circuit controls currents flowing to the first nonlinear element and the second nonlinear element based on an output voltage of the current controlling circuit itself. The N temperature characteristic adjusting elements individually adjust the temperature characteristics of the output voltage of the current controlling circuit.

The reference signal generating circuits according to the present embodiments will be described below with reference to the accompanying drawings. Note that the present invention is not limited to the embodiments.

First Embodiment

Figure 1:
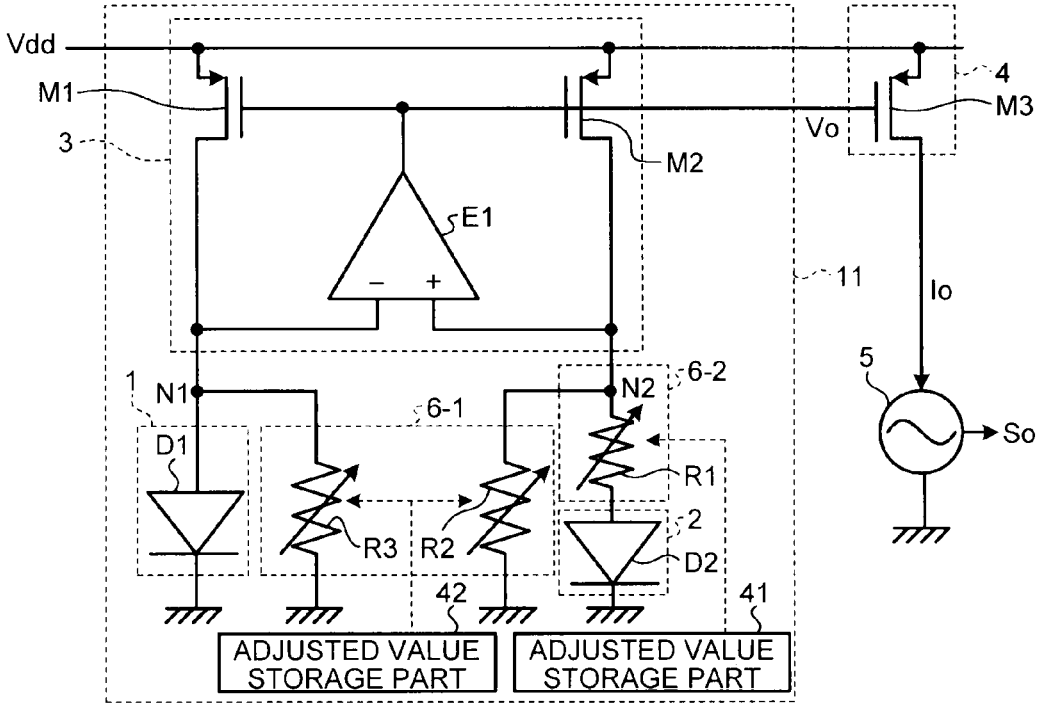
FIG. 1 is a schematic circuit diagram of a reference signal generating circuit according to a first embodiment.

FIG. 1 is a schematic circuit diagram of a reference signal generating circuit according to a first embodiment.

As illustrated in FIG. 1, the reference signal generating circuit 11 is provided with nonlinear elements 1 and 2, a current controlling circuit 3, temperature characteristic adjusting elements 6-1 and 6-2, and adjusted value storage parts 41 and 42. The nonlinear element 1 can generate a first reference voltage. The nonlinear element 2 can generate a second reference voltage. The nonlinear elements 1 and 2 are respectively constituted by diodes D1 and D2. Incidentally, the first reference voltage and the second reference voltage can be set based on, for example, the bandgap energy of silicon. To make the value of the first reference voltage and the value of the second reference voltage different from each other, the sizes of the diodes D1 and D2 can be made different from each other; for example, the size of the diode D2 can be made larger than the size of the diode D1. And further, as the nonlinear elements 1 and 2, transistor circuits or the like may be used instead of the diodes D1 and D2.

The temperature characteristic adjusting elements 6-1 and 6-2 can individually adjust the temperature characteristics of an output voltage Vo of the current controlling circuit 3. The temperature characteristic adjusting element 6-1 is constituted by variable resistances R2 and R3, and the temperature characteristic adjusting element 6-2 is constituted by a variable resistance R1. Incidentally, at the variable resistances R2 and R3, resistance values can be varied simultaneously, and the gradient of the output voltage Vo with respect to temperature can be adjusted. The variable resistance R1 can smooth a difference in reference voltage between the diodes D1 and D2, and can adjust the gradient of the output voltage Vo with respect to temperature. And further, at the variable resistance R1, the adjustable range of resistance values can be narrowed down as compared with the adjustable range of resistance values at the variable resistances R2 and R3.

The diode D1 and the variable resistance R3 are coupled in parallel with each other. At the connection point of an anode of the diode D1 and the variable resistance R3, a node N1 is provided. The diode D2 and the variable resistance R1 are coupled in series with each other, and a series circuit constituted by the diode D2 and the variable resistance R1 is coupled in parallel with the variable resistance R2. At the connection point of the variable resistances R1 and R2, a node N2 is provided.

The current controlling circuit 3 can control currents flowing to the nonlinear elements 1 and 2 based on the output voltage Vo. The current controlling circuit 3 is constituted by an operational amplifier E1 and transistors M1 and M2. Incidentally, as the transistors M1 and M2, P-channel field effect transistors can be used. An inverting input terminal of the operational amplifier E1 is coupled with the node N1, and a non-inverting input terminal of the operational amplifier E1 is coupled with the node N2.

Gates of the transistors M1 and M2 are coupled with an output terminal of the operational amplifier E1, and sources of the transistors M1 and M2 are coupled to a power source potential Vdd. A drain of the transistor M1 is coupled with the node N1, and a drain of the transistor M2 is coupled with the node N2.

The adjusted value storage part 41 stores an adjusted resistance value at the variable resistance R1, and the adjusted value storage part 42 stores adjusted resistance values at the variable resistances R2 and R3. Incidentally, as the adjusted value storage parts 41 and 42, fuse elements may be used, or registers may be used.

The reference signal generating circuit 11 is coupled to an oscillator 5 via a current output circuit 4. The current output circuit 4 can convert the output voltage Vo of the current controlling circuit 3 to an output current Io. The current output circuit 4 is constituted by a transistor M3. Incidentally, as the transistor M3, a P-channel field effect transistor can be used.

A gate of the transistor M3 is coupled with the output terminal of the operational amplifier E1, and a source of the transistor M3 is coupled with the power source potential Vdd. From a drain of the transistor M3, the output current Io is output.

The oscillator 5 can generate an oscillating signal So. And further, the oscillator 5 can change the oscillation frequency of the oscillating signal So based on the output current Io.

Next, the operational amplifier E1 compares the potential of the node N1 and the potential of the node N2. Then the output voltage Vo of the operational amplifier E1 is controlled so that the potential difference between the nodes N1 and N2 approaches zero, following which the controlled output voltage Vo is applied to the gates of the transistors M1 to M3. When the output voltage Vo has been applied to the gates of the transistors M1 and M2, not only are currents fed to the diode D1 and the variable resistance R3 via the node N1, but currents are fed to the diode D2 and the variable resistances R1 and R2 via the node N2.

The diodes D1 and D2 have positive temperature characteristics with respect to current (i.e., have negative temperature characteristics with respect to voltage), but the variable resistances R1 to R3 have negative temperature characteristics with respect to current (i.e., have positive temperature characteristics with respect to voltage). Therefore, when temperature has risen, reference voltages at the diodes D1 and D2 drop, and voltage drops by the variable resistances R1 to R3 proceed reversely. Then the drops in the reference voltages at the diodes D1 and D2 result in potential drops at the nodes N1 and N2, and the reverse proceedings of the voltage drops by the variable resistances R1 to R3 result in potential rises at the nodes R1 and R2.

When the degrees of the potential drops at the nodes N1 and N2 due to the drops in the reference voltages at the diodes D1 and D2 are above the degrees of the potential rises at the nodes N1 and N2 due to the reverse proceedings of the voltage drops by the variable resistances R1 to R3, the output voltage Vo of the operational amplifier E1 drops. In contrast, when the degrees of the potential drops at the nodes N1 and N2 due to the drops in the reference voltages at the diodes D1 and D2 are below the degrees of the potential rises at the nodes N1 and N2 due to the reverse proceedings of the voltage drops by the variable resistances R1 to R3, the output voltage Vo of the operational amplifier E1 rises.

When the output voltage Vo of the operational amplifier E1 has dropped, the output current Io of the current output circuit 4 increases; when the output voltage Vo of the operational amplifier E1 has risen, the output current Io of the current output circuit 4 decreases.

When the temperature has risen, the oscillation frequency of the oscillating signal So generated by the oscillator 5 increases. Therefore, by canceling out the increase in the oscillation frequency of the oscillating signal So generated by the oscillator 5 by the amount of the change in the output current Io, it is possible to compensate for the variation in the oscillation frequency of the oscillating signal So due to the temperature change.

To improve accuracy in the compensation for the variation in the oscillation frequency of the oscillating signal So due to the temperature change, the gradient of the variation in the output current Io due to the temperature change can be set so that the gradient of the variation in the oscillation frequency of the oscillating signal So due to the temperature change is canceled out.

At that time, by increasing resistance values at the variable resistances R2 and R3, the gradient of the variation in the output current Io due to the temperature change ascends. In contrast, by increasing a resistance value at the variable resistance R1, the gradient of the variation in the output current Io due to the temperature change descends.

Therefore, by adjusting the resistance values at the variable resistances R1 to R3, the gradient of the variation in the output current Io due to the temperature change can be adjusted, and the increase in the oscillation frequency of the oscillating signal So generated by the oscillator 5 can be canceled out by the amount of the change in the output current Io. At that time, the adjusted resistance values at the variable resistances R1 to R3 can be stored in the adjusted value storage parts 41 and 42.

Furthermore, by allowing not only the resistance values at the variable resistances R2 and R3 but the resistance value at the variable resistance R1 to be adjusted, the variable ranges of the resistance values at the variable resistances R2 and R3 can be narrowed. Therefore, as compared with the case where only the resistance values at the variable resistances R2 and R3 are allowed to be adjusted, an increase in power consumption by the variable resistances R2 and R3 can be prevented, and layout areas of the variable resistances R2 and R3 can be reduced.

Figure 2A:
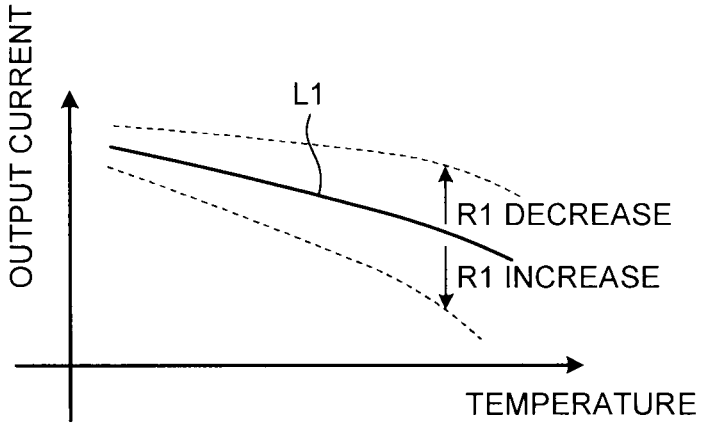
FIG. 2A is a graph illustrating the relationship between temperature and output current at the time when having imparted PTAT characteristics to the reference signal generating circuit of FIG. 1.
Figure 2B:
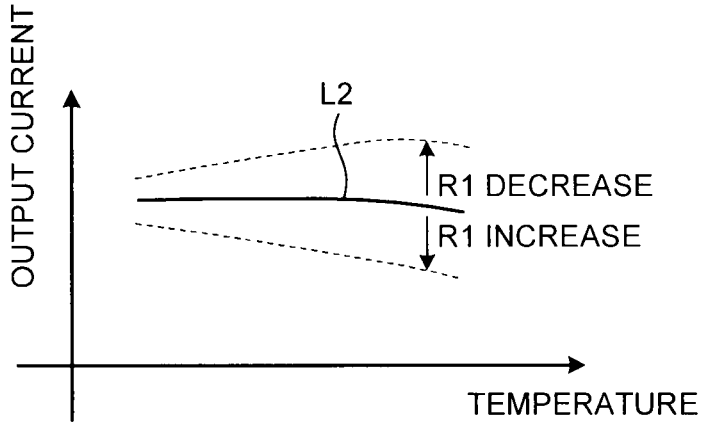
FIG. 2B is a graph illustrating the relationship between temperature and output current at the time when having imparted Const characteristics to the reference signal generating circuit of FIG. 1.
Figure 2C:
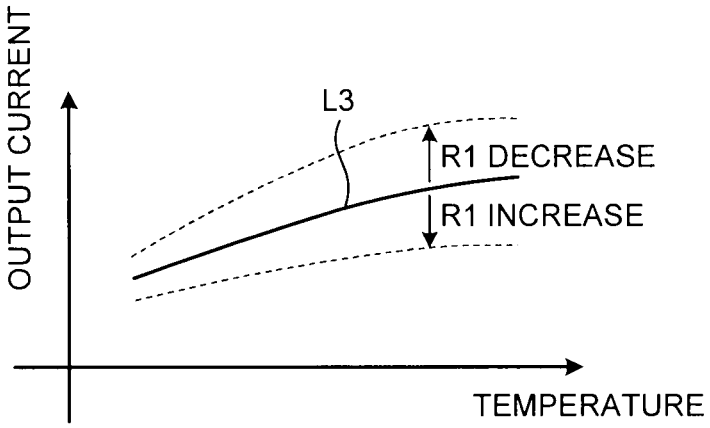
FIG. 2C is a graph illustrating the relationship between temperature and output current at the time when having imparted NTAT characteristics to the reference signal generating circuit of FIG. 1.

FIG. 2A is a graph illustrating the relationship between temperature and output current at the time when having imparted PTAT (proportional to absolute temperature) characteristics to the reference signal generating circuit of FIG. 1. FIG. 2B is a graph illustrating the relationship between temperature and output current at the time when having imparted Const (Constant to absolute temperature) characteristics to the reference signal generating circuit of FIG. 1. FIG. 2C is a graph illustrating the relationship between temperature and output current at the time when having imparted NTAT (negative to absolute temperature) characteristics to the reference signal generating circuit of FIG. 1.

As illustrated in FIG. 2A, by increasing the resistance values at the variable resistances R2 and R3, the influence of the temperature characteristics of the variable resistances R2 and R3 becomes large compared with the influence of the temperature characteristics of the diodes D1 and D2. Therefore, when the temperature has risen, the potentials of the nodes N1 and N2 heighten, and the output voltage Vo of the operational amplifier E1 rises. As a result, the output current Io of the current output circuit 4 decreases, and the reference signal generating circuit of FIG. 1 shows NTAT characteristics L1.

In that case, by increasing the resistance value at the variable resistance R1, the voltage drop at the variable resistance R1 increases, and the potentials of the nodes N1 and N2 heighten, whereby the output voltage Vo of the operational amplifier E1 rises. As a result, the output current Io of the current output circuit 4 decreases, and the gradient of the PTAT characteristics L1 descends.

As illustrated in FIG. 2C, by decreasing the resistance values at the variable resistances R2 and R3, the influence of the temperature characteristics of the variable resistances R2 and R3 becomes little as compared with the influence of the temperature characteristics of the diodes D1 and D2. Therefore, when the temperature has risen, the potentials of the nodes N1 and N2 lower, and the output voltage Vo of the operational amplifier E1 drops. As a result, the output current Io of the current output circuit 4 increases, and the reference signal generating circuit of FIG. 1 shows PTAT characteristics L3.

As illustrated in FIG. 2B, by setting the resistance values at the variable resistances R2 and R3 so that the influence of the temperature characteristics of the variable resistances R2 and R3 and the influence of the temperature characteristics of the diodes D1 and D2 becomes equal to each other, the potentials of the nodes N1 and N2 are held constant, and the output voltage Vo of the operational amplifier E1 is held constant even when the temperature has changed. As a result, the output current Io of the current output circuit 4 is held constant, and the reference signal generating circuit of FIG. 1 shows Const characteristics L2.

Figure 3A:
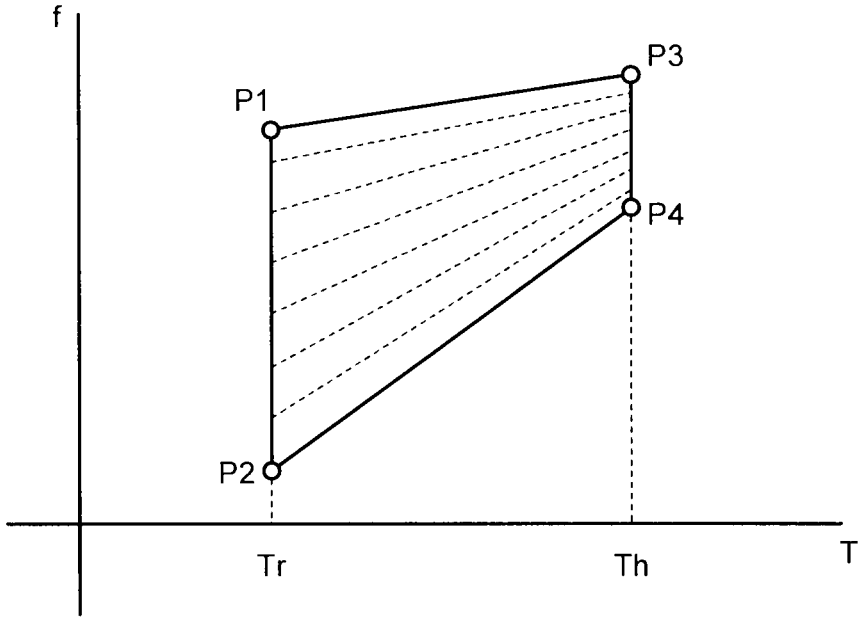
FIG. 3A is a graph illustrating the relationship between oscillation frequencies of an oscillator in the variable ranges of resistance values at variable resistances R1 and R2 and temperatures at the time when having decreased a resistance value at a variable resistance R3 in the reference signal generating circuit of FIG. 1.
Figure 3A:
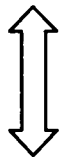
Figure 3B:
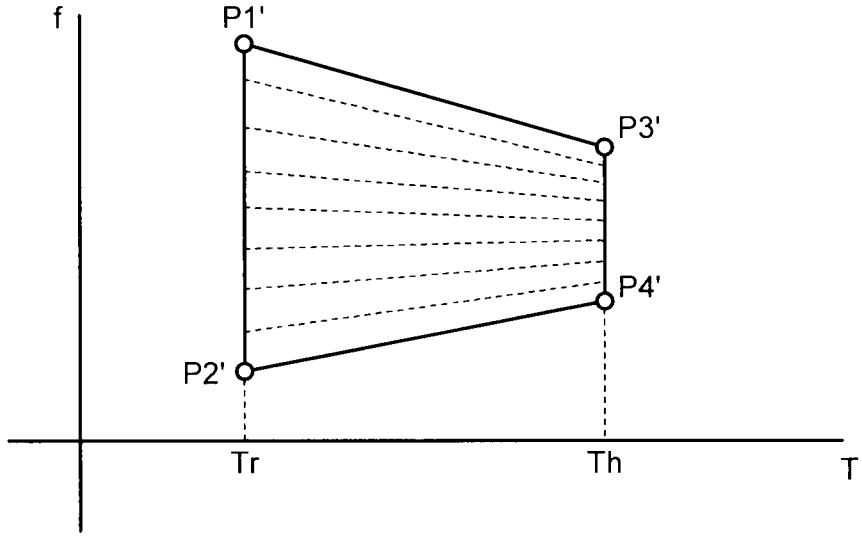
FIG. 3B is a graph illustrating the relationship between oscillation frequencies of the oscillator in the variable ranges of resistance values at the variable resistances R1 and R2 and the temperatures at the time when having increased a resistance value at the variable resistance R3 in the reference signal generating circuit of FIG. 1.

FIG. 3A is a graph illustrating the relationship between the oscillation frequencies of the oscillator in the variable range of the resistance values at the variable resistances R1 and R2 and temperatures at the time when having decreased the resistance value at the variable resistance R3 in the reference signal generating circuit of FIG. 1. FIG. 3B is a graph illustrating the relationship between the oscillation frequencies of the oscillator in the variable range of the resistance values at the variable resistances R1 and R2 and the temperatures at the time when having increased the resistance value at the variable resistance R3 in the reference signal generating circuit of FIG. 1.

In FIG. 3A, reference alphanumeric P1 denotes the oscillation frequency of the oscillator 5 at room temperature Tr at the time when having set the resistance values at the variable resistances R2 and R3 at the minimum value in the variable range, reference alphanumeric P2 denotes the oscillation frequency of the oscillator 5 at room temperature Tr at the time when having set the resistance values at the variable resistances R2 and R3 at the maximum value in the variable range, reference alphanumeric P3 denotes the oscillation frequency of the oscillator 5 at high temperature Th at the time when having set the resistance values at the variable resistances R2 and R3 at the minimum value in the variable range, and reference alphanumeric P4 denotes the oscillation frequency of the oscillator 5 at high temperature Th at the time when having set the resistance values at the variable resistances R2 and R3 at the maximum value in the variable range. Even when the resistance values at the variable resistances R2 and R3 have been set at whatever value in the variable range in those cases, there is no value at which the frequency characteristics of the oscillator 5 are kept constant.

When the resistance value at the variable resistance R1 has been decreased in those cases, the oscillation frequencies P1 to P4 respectively change to oscillation frequencies P1' to P4' as illustrated in FIG. 3B. In these cases, the resistance values at the variable resistances R2 and R3 can be adjusted in the variable range so that the frequency characteristics of the oscillator 5 are kept constant.

In that case, the resistance value at the variable resistance R1 may be set within the variable range of the variable resistance R1 in which the frequency characteristics of the oscillator 5 are kept constant so that the reference signal generating circuit of FIG. 1 consumes only minimum power, or the resistance value at the variable resistance R1 may be set in consideration of noise, linearity, or the like.

Figure 4:
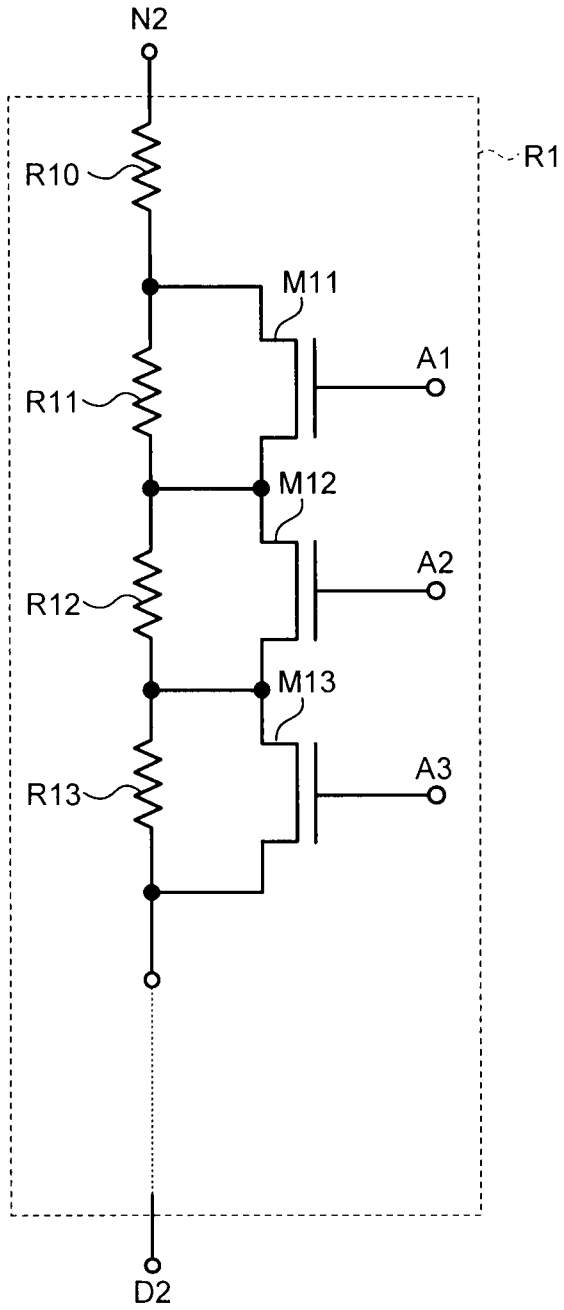
FIG. 4 is a schematic circuit diagram of one example of the variable resistance R3 in the reference signal generating circuit of FIG. 1.

FIG. 4 is a schematic circuit diagram of one example of the variable resistance R1 in the reference signal generating circuit of FIG. 1.

As illustrated in FIG. 4, the variable resistance R1 includes transistors M11 to M13 and resistances R10 to R13. Incidentally, as the transistors M11 to M13, for example, N-channel field effect transistors can be used. In the variable resistance R1, the resistances R10 to R13 are coupled in series together, the resistance R11 is coupled in parallel with the transistor M11, the resistance R12 is coupled in parallel with the transistor M12, and the resistance R13 is coupled in parallel with the transistor M13. To gates of the transistors M11 to M13, switching signals A1 to A3 are input respectively.

When the number of the transistors M11 to M13 turned on by the switching signals A1 to A3 increases, the resistance value at the variable resistance R1 decreases. In contrast, when the number of the transistors M11 to M13 turned off by the switching signals A1 to A3 increases, the resistance value at the variable resistance R1 increases. That is, by increasing or decreasing the number of the transistors M11 to M13 turned on by the switching signals A1 to A3, the resistance value at the variable resistance R1 can be increased or decreased. Incidentally, the values of the switching signals A1 to A3 can be stored in the adjusted value storage part 41.

In the example of FIG. 4, a method is shown in which the resistance value at the variable resistance R1 is changed in four steps by providing three transistors M11 to M13 and four resistances R10 to R13; however the resistance value at the variable resistance R1 may be changed in k steps (k is an integer of 2 or larger). And further, the variable resistances R2 and R3 can be configured as in the case of the variable resistance R1.

Figure 5:
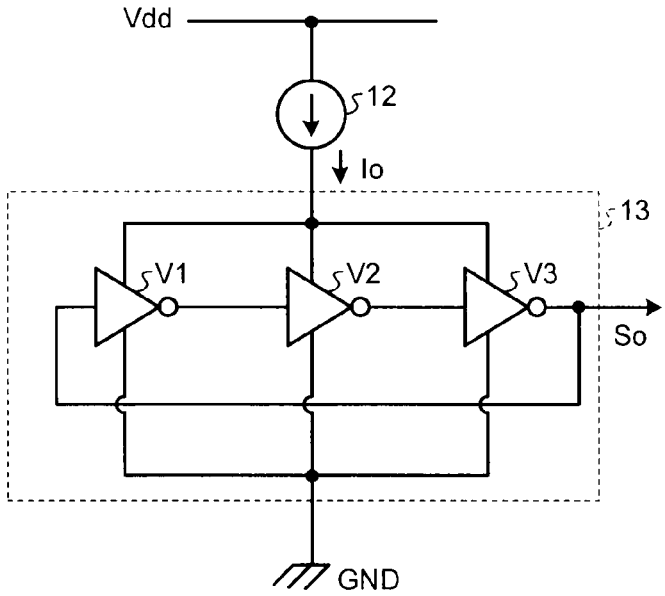
FIG. 5 is a schematic circuit diagram of one example of a ring oscillator to which the reference signal generating circuit of FIG. 1 is applied.

FIG. 5 is a schematic circuit diagram of one example of a ring oscillator to which the reference signal generating circuit of FIG. 1 is applied.

As illustrated in FIG. 5, to a ring oscillator 13, a reference current generating circuit 12 is coupled; reference current Io is fed from the reference current generating circuit 12 to the ring oscillator 13. Incidentally, the reference current generating circuit 12 can be constituted by the reference signal generating circuit 11 and the current output circuit 4 of FIG. 1.

The ring oscillator 13 includes inverters V1 to V3. The inverters V1 to V3 are coupled in series one after the other, and the output of the final-stage inverter V3 is fed back to the input of the first-stage inverter V1.

The oscillation frequency f of the ring oscillator 13 depends on a propagation delay time $\tau$ and a step number N at the inverters V1 to V3 ($f \propto N\tau$). The propagation delay time $\tau$ is proportional to the load capacity C of the inverters V1 to V3, but is inversely proportional to operating current I and operating temperature T, and thus the relationship between the oscillation frequency f and the operating temperature T is expressed by the expression $f \propto IT/C$.

Therefore, by imparting the NTAT characteristics to the output current Io, a variation in the oscillation frequency f due to the operating temperature T can be canceled out, and the temperature characteristics of the ring oscillator 13 can be compensated.

Second Embodiment

Figure 6:
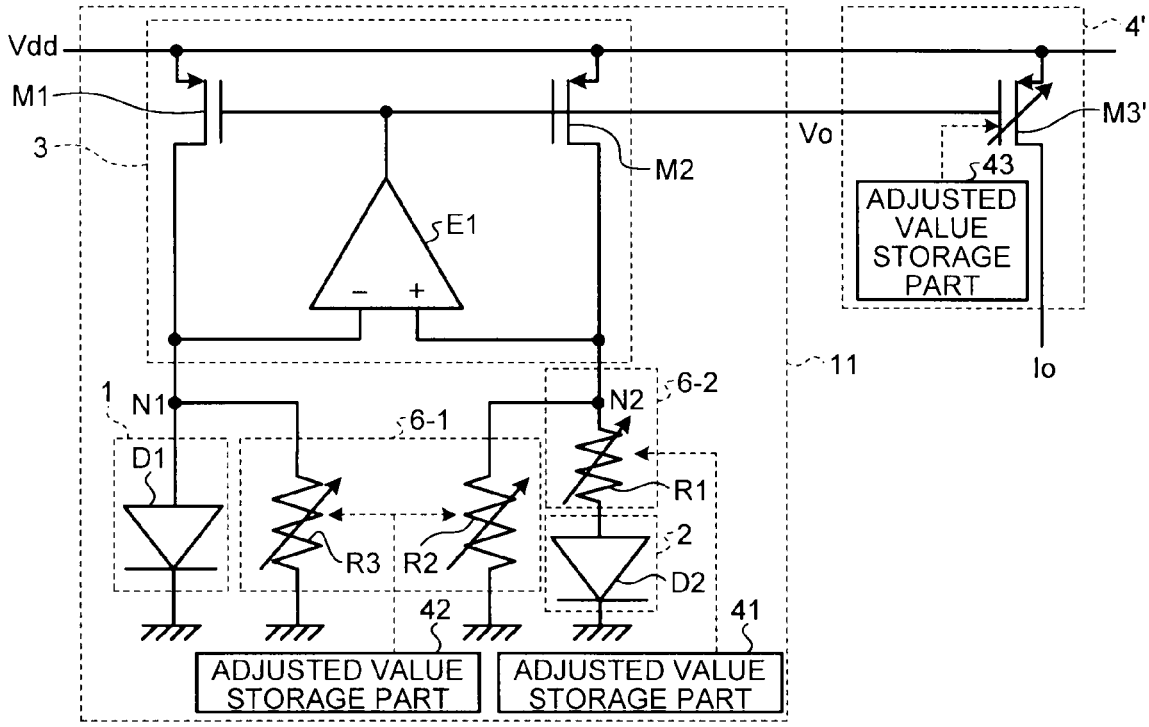
FIG. 6 is a schematic circuit diagram of a reference signal generating circuit according to a second embodiment.

FIG. 6 is a schematic circuit diagram of a reference signal generating circuit according to a second embodiment.

As illustrated in FIG. 6, to the reference signal generating circuit, a current output circuit 4' is coupled instead of the current output circuit 4 of FIG. 1. The current output circuit 4' can convert output voltage Vo of the current controlling circuit 3 to output current Io, and can adjust the temperature characteristics of the reference signal generating circuit 11. The current output circuit 4' includes a variable transistor M3' and an adjusted value storage part 43. The variable transistor M3' can change the output current Io corresponding to the output voltage Vo. In the adjusted value storage part 43, an adjusted value at the variable transistor M3' is stored. Incidentally, as the adjusted value storage part 43, a fuse element may be used, or a resistor may be used.

To improve accuracy of compensation for a variation in the oscillation frequency of the oscillating signal So due to temperature change, the gradient of a variation in the output current Io due to the temperature change can be set so that the gradient of the variation in the oscillation frequency of the oscillating signal So due to the temperature change is canceled out.

In that case, by increasing or decreasing the value of the output current Io, the gradient of the variation in the output current Io due to the temperature change can be increased or decreased. That is, by adjusting the value of the output current Io, the gradient of the variation in the output current Io due to the temperature change can be adjusted, and the variation in the oscillation frequency of the oscillating signal So from the oscillator 5 can be canceled out by the amount of the change in the output current Io.

Furthermore, by allowing not only resistance values at the variable resistances R1 to R3 but the output current Io to be adjusted, the variable range of the resistance values at the variable resistances R1 to R3 can be narrowed. Therefore, as compared with the case where only the resistance values at the variable resistances R1 to R3 are allowed to be adjusted, an increase in power consumption by the variable resistances R1 to R3 can be reduced, and the layout areas of the valuable resistances R1 to R3 can be reduced.

Although the reference signal generating method in which the variable resistances R1 to R3 and the variable transistor M3' are variable has been described in the embodiment of FIG. 6, a fixed resistance may be used instead of the variable resistance R1 with the variable resistances R2 and R3 and the variable transistor M3' being variable.

Figure 7:
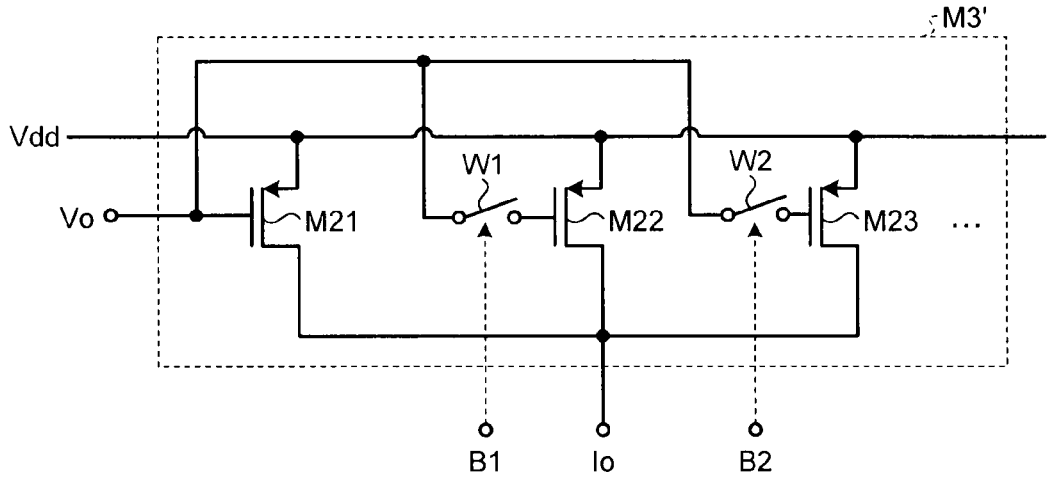
FIG. 7 is a schematic circuit diagram of one example of a variable transistor M3' in the reference signal generating circuit of FIG. 6.

FIG. 7 is a schematic circuit diagram of one example of the variable transistor M3' in the reference signal generating circuit of FIG. 6.

As illustrated in FIG. 7, the variable transistor M3' includes transistors M21 to M23 and switches W1 and W2. Incidentally, as the transistors M21 to M23, P-channel field effect transistors can be used, for example. The transistors M21 to M23 are coupled in parallel to one another. To a gate of the transistor M21, output voltage Vo is applied; to a gate of the transistor M22, the output voltage Vo is applied via the switch W1; to a gate of the transistor M23, the output voltage Vo is applied via the switch W2. The switches W1 and W2 are respectively turned on/off with switching signals B1 and B2.

When the number of the switches W1 and W2 turned on by the switching signals B1 and B2 increases, output current Io of the variable transistor M3' increases. In contrast, when the number of the switches W1 and W2 turned off by the switching signals B1 and B2 increases, the output current Io of the variable transistor M3' decreases. That is, by increasing or decreasing the number of the transistors M21 to M23 turned on by the switching signals B1 and B2, the output current Io can be increased or decreased. Incidentally, the values of the switching signals B1 and B2 can be stored in the adjusted value storage part 43.

In the example of FIG. 7 is shown the method of changing the output current Io in three steps by providing three transistors M21 to M23 and two switches W1 and W2, whereas the output current Io may be changed in m steps (m is an integer of 2 or larger).

Third Embodiment

Figure 8:
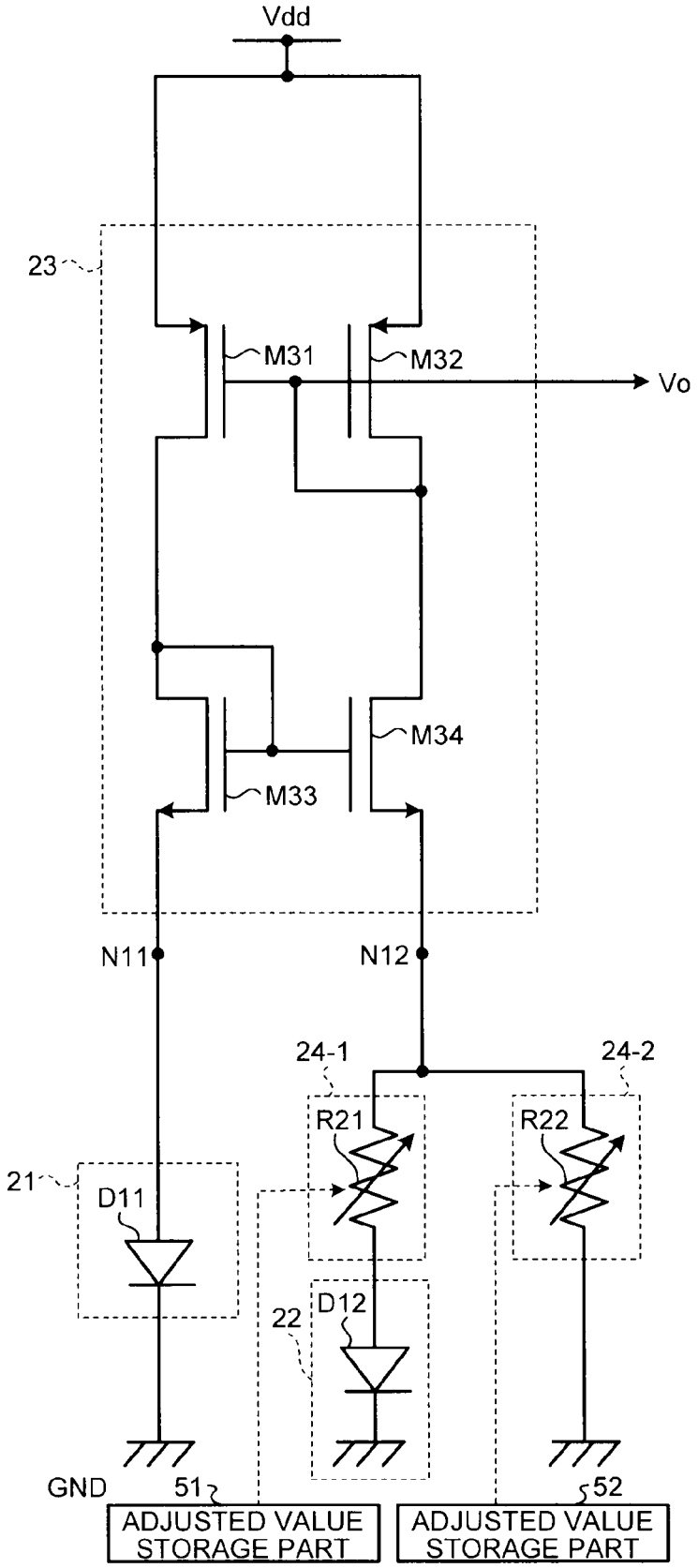
FIG. 8 is a schematic circuit diagram of a reference signal generating circuit according to a third embodiment.

FIG. 8 is a schematic circuit diagram of a reference signal generating circuit according to a third embodiment.

As illustrated in FIG. 8, the reference signal generating circuit includes nonlinear elements 21 and 22, a current controlling circuit 23, temperature characteristic adjusting elements 24-1 and 24-2, and adjusted value storage parts 51 and 52.

The nonlinear element 21 can generate a first reference voltage. The nonlinear element 22 can generate a second reference voltage. The nonlinear elements 21 and 22 are respectively constituted by diodes D11 and D12. To make the value of the first reference voltage and the value of the second reference voltage different from each other, the sizes of the diodes D11 and D12 can be made different from each other.

The temperature characteristic adjusting elements 24-1 and 24-2 can individually adjust the temperature characteristics of an output voltage Vo of the current controlling circuit 23. The temperature characteristic adjusting element 24-1 is constituted by a variable resistance R21, and the temperature characteristic adjusting element 24-2 is constituted by a variable resistance R22. The variable resistance R22 can adjust the gradient of the output voltage Vo with respect to temperature. The variable resistance R21 can smooth a difference in reference voltage between the diodes D11 and D12, and can adjust the gradient of the output voltage Vo with respect to the temperature.

An anode of the diode D11 is coupled with a node N11. The diode D12 and the variable resistance R21 are coupled in series with each other, and a series circuit constituted by the diode D12 and the variable resistance R21 is coupled in parallel with the variable resistance R22. At the connection point of the variable resistances R21 and R22, a node N12 is provided.

The current controlling circuit 23 can control currents flowing to the nonlinear elements 21 and 22 based on the output voltage Vo. The current controlling circuit 23 includes transistors M31 to M34. Incidentally, as the transistors M31 and M32, P-channel field effect transistors can be used; as the transistors M33 and M34, N-channel field effect transistors can be used. The transistors M31 and M33 are coupled in series with each other, and the transistors M32 and M34 are coupled in series with each other. Gates of the transistors M33 and M34 are coupled with a drain of the transistor M33, and gates of the transistors M31 and M32 are coupled with a drain of the transistor M32.

Sources of the transistors M31 and M32 are coupled to the power source potential Vdd. A source of the transistor M33 is coupled with the node N11. A source of the transistor M34 is coupled with the node N12.

In the adjusted value storage part 51, an adjusted value at the variable resistance R21 is stored; in the adjusted value storage part 52, an adjusted value at the variable resistance R22 is stored. Incidentally, as the adjusted value storage parts 51 and 52, fuse elements may be used, or resistors may be used.

Drain currents at the transistors M33 and M34 are made identical by current mirror operations of the transistors M31 and M32. And further, currents flowing at the nodes N11 and N12 are made identical by current mirror operations of the transistors M33 and M34, and a difference in potential between the nodes N11 and N12 is adjusted so that the difference approaches zero. Then the current is fed to the diode D11 via the node N11, and the current is fed to the diode D12 and the variable resistances R21 and R22 via the node N12.

The diodes D11 and D12 have positive temperature characteristics with respect to current (i.e., have negative temperature characteristics with respect to voltage), but the variable resistances R21 and R22 have negative temperature characteristics with respect to current (i.e., have positive temperature characteristics with respect to voltage). Therefore, when the temperature has risen, reference voltages at the diodes D11 and D12 drop, and voltage drops by the variable resistances R21 and R22 proceed reversely. Then the drops in the reference voltages at the diodes D11 and D12 result in potential drops at the nodes N11 and N12, but the reverse proceedings of the voltage drops by the variable resistances R21 and R22 result in potential rises at the nodes N11 and N12.

When the degrees of the potential drops at the nodes N11 and N12 due to the reference voltage drops at the diodes D11 and D12 are above the degrees of the potential rises at the nodes N11 and N12 due to the reverse proceedings of the voltage drops by the variable resistances R21 and R22, the output voltage Vo of the current controlling circuit 23 drops. In contrast, when the degrees of the potential drops at the nodes N11 and N12 due to the reference voltage drops at the diodes D11 and D12 are below the degrees of the potential rises at the nodes N11 and N12 due to the reverse proceedings of the voltage drops by the variable resistances R21 and R22, the output voltage Vo of the current controlling circuit 23 rises.

Therefore, by adjusting resistance values at the variable resistances R21 and R22, the gradient of a variation in the output voltage Vo due to a change in the temperature can be adjusted. The adjusted resistance values at the variable resistances R21 and R22 can respectively be stored in the adjusted value storage parts 51 and 52.

Furthermore, by allowing not only the resistance value at the variable resistance R22 but the resistance value at the variable resistance R21 to be adjusted, the variable range of the resistance value at the variable resistance R22 can be narrowed. Hence, as compared with the case where only the resistance value at the variable resistance R22 is allowed to be adjusted, an increase in power consumption by the variable resistance R22 can be reduced, and the layout area of the variable resistance R22 can also be reduced.

Fourth Embodiment

Figure 9:
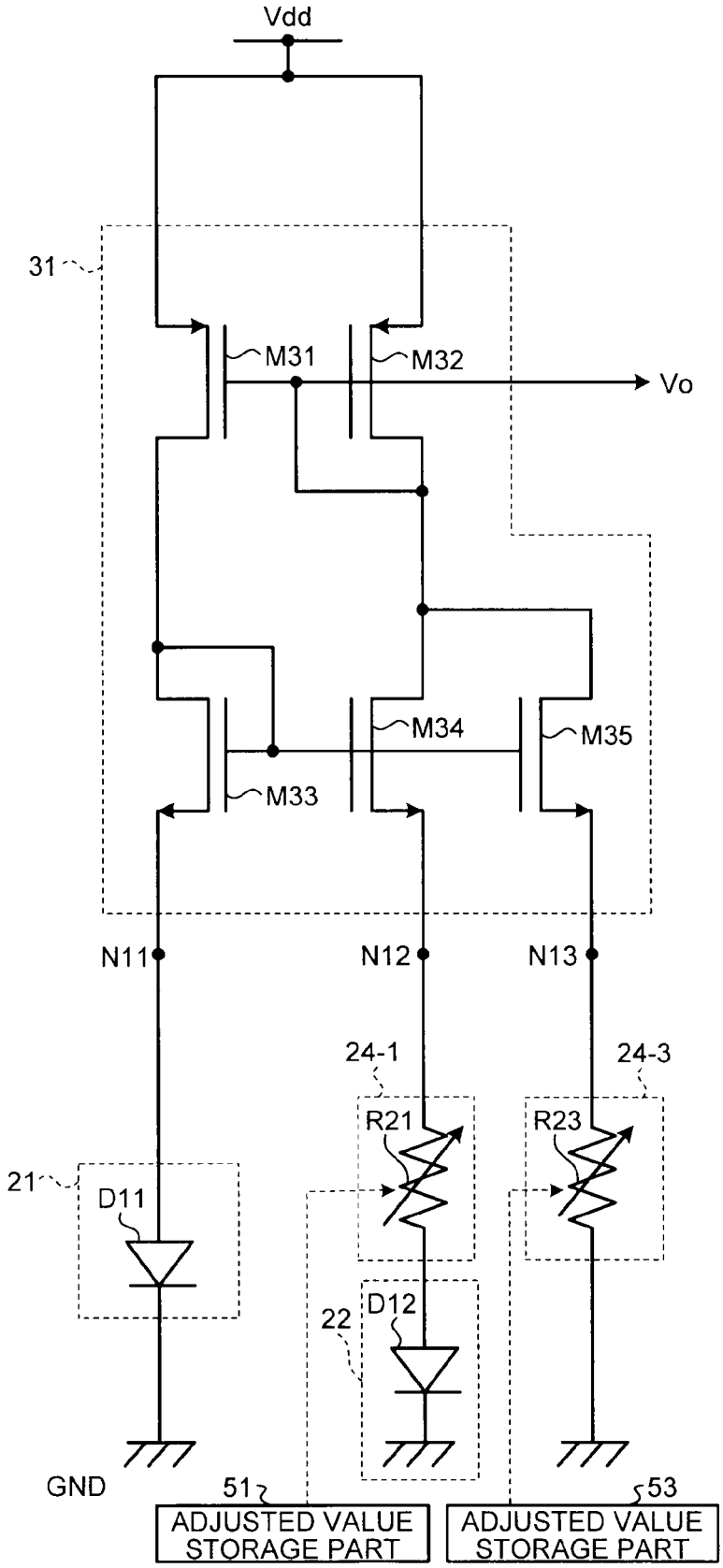
FIG. 9 is a schematic circuit diagram of a reference signal generating circuit according to a fourth embodiment.

FIG. 9 is a schematic circuit diagram of a reference signal generating circuit according to a fourth embodiment.

As illustrated in FIG. 9, the reference signal generating circuit is provided with a current controlling circuit 31, a temperature characteristic adjusting element 24-3, and an adjusted value storage part 53 instead of the current controlling circuit 23, the temperature characteristic adjusting element 24-2, and the adjusted value storage part 52 in the reference signal generating circuit of FIG. 8.

The current controlling circuit 31 has a configuration in which a transistor M35 is added to the current controlling circuit 23. Incidentally, as the transistor M35, an N-channel field effect transistor can be used. The temperature characteristic adjusting element 24-3 is constituted by a variable resistance R23. In the configuration of FIG. 8, the variable resistance R22 is coupled with the node N12; however, in the configuration of FIG. 9, the variable resistance R23 is coupled with a node N13. In the adjusted value storage part 53, an adjusted resistance value at the variable resistance R23 is stored. Incidentally, as the adjusted value storage part 53, a fuse element may be used, or a resistor may be used.

A drain of the transistor M35 is coupled with the drain of the transistor M34. A source of the transistor M35 is coupled with the node N13. A gate of the transistor M35 is coupled with the gate of the transistor M34.

In the configuration of FIG. 8, a negative secondary temperature coefficient is generated based on the temperature characteristics of a current flowing to the variable resistance R22 in accordance with a difference in nonlinearity between the diodes D11 and D12. In contrast, in the configuration of FIG. 9, a positive secondary temperature coefficient is generated based on the temperature characteristics of a voltage generated at the variable resistance R23 in accordance with the difference in the nonlinearity between the diodes D11 and D12. Therefore it is possible to generate a reference current having the positive secondary temperature coefficient and to easily compensate a secondary temperature coefficient at the reference signal generating circuit.

In the above embodiments, the descriptions of concrete examples of the parameters for controlling the output currents of the BGR circuits to correct the temperature characteristics of the BGR circuits have been made. In general, in the case where a function $y=f(x1, x2, \ldots, xN)$ is given in which the N parameters x1, x2, . . . , and xN (N is an integer of 2 or larger) of an output signal y are used as variables, the temperature characteristics of BGR circuits can be corrected using two or more of the parameters x1, x2, . . . , and xN. Therefore, as compare with a method of correcting the temperature characteristics of the BGR circuits by using only one of the parameters x1, x2, . . . , and xN, the variable range of the parameters x1, x2, . . . , and xN can be narrowed, power consumption by the BGR circuits can be reduced, and the layout areas of the BGR circuits can be reduced.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A reference signal generating circuit comprising:

a first nonlinear element that generates a first reference voltage;

a second nonlinear element that generates a second reference voltage;

a current controlling circuit that controls a current flowing to the first nonlinear element and a current flowing to the second nonlinear element based on an output voltage of the current controlling circuit itself; and N temperature characteristic adjusting elements (N is an integer of 2 or larger) that individually adjust temperature characteristics of the output voltage of the current controlling circuit, each of the temperature characteristic adjusting elements comprising:

a first variable resistance coupled in series to the second nonlinear element;

a second variable resistance coupled in parallel to a series circuit comprised of the second nonlinear element and the first variable resistance; and a third variable resistance coupled in parallel to the first nonlinear element, wherein a resistance value at the first variable resistance is adjusted so that frequency characteristics of an oscillator with respect to temperature are evened out in an adjustable range of resistance values at the second variable resistance and the third variable resistance, an output current generated on the basis of the output voltage being supplied to the oscillator.

2. The reference signal generating circuit according to claim 1, wherein the first nonlinear element is a first diode, and the second nonlinear element is a second diode.

3. The reference signal generating circuit according to claim 1, further comprising a current output circuit that converts the output voltage to the output current.

4. The reference signal generating circuit according to claim 3, the reference signal generating circuit being coupled to a ring oscillator via the current output circuit.

5. The reference signal generating circuit according to claim 4, wherein resistance values at the first, the second, and the third variable resistances are set so that an increase in an oscillation frequency of an oscillating signal from the ring oscillator is canceled out by an amount of a change in the output current.

6. The reference signal generating circuit according to claim 5, further comprising an adjusted value storage part that stores the resistance values at the first, the second, and the third variable resistances.

7. The reference signal generating circuit according to claim 4, wherein NTAT characteristics are imparted to the output current so that a variation in an oscillation frequency of the ring oscillator due to an operating temperature are canceled out.

8. The reference signal generating circuit according to claim 3, wherein the current output circuit comprises a variable transistor that generates the output current corresponding to the output voltage.

9. The reference signal generating circuit according to claim 1, wherein the current controlling circuit comprises:

an operational amplifier that controls the output voltage so that a difference between a potential of a first node provided to a connection point of the first nonlinear element and the third variable resistance and a potential of a second node provided to a connection point of the series circuit and the second variable resistance approaches zero;

a first transistor, a gate of which is driven by the output voltage and a drain of which is coupled with the first node; and a second transistor, a gate of which is driven by the output voltage and a drain of which is coupled with the second node.

10. A reference signal generating circuit comprising:

a first nonlinear element that generates a first reference voltage;

a second nonlinear element that generates a second reference voltage;

a current controlling circuit that controls a current flowing to the first nonlinear element and a current flowing to the second nonlinear element based on an output voltage of the current controlling circuit itself; and N temperature characteristic adjusting elements (N is an integer of 2 or larger) that individually adjust temperature characteristics of the output voltage of the current controlling circuit, each of the temperature characteristic adjusting elements comprising:

a first variable resistance coupled in series to the second nonlinear element;

a second variable resistance coupled in parallel to a series circuit comprised of the second nonlinear element and the first variable resistance; and a third variable resistance coupled in parallel to the first nonlinear element, wherein resistance values at the second variable resistance and the third variable resistance are adjusted so that frequency characteristics of an oscillator with respect to temperature are evened out in an adjustable range of a resistance value at the first variable resistance, an output current generated on the basis of the output voltage being supplied to the oscillator.

11. A reference signal generating circuit comprising:

a first nonlinear element that generates a first reference voltage;

a second nonlinear element that generates a second reference voltage;

a current controlling circuit that controls a current flowing to the first nonlinear element and a current flowing to the second nonlinear element based on an output voltage of the current controlling circuit itself; and N temperature characteristic adjusting elements (N is an integer of 2 or larger) that individually adjust temperature characteristics of the output voltage of the current controlling circuit, each of the temperature characteristic adjusting elements comprising:

a first variable resistance coupled in series to the second nonlinear element; and a second variable resistance coupled in parallel to a series circuit comprised of the second nonlinear element and the first variable resistance, wherein resistance values at the first variable resistance and the second variable resistance are adjusted so that frequency characteristics of an oscillator with respect to temperature are evened out in an adjustable range of resistance values at the first variable resistance and the second variable resistance, an output current generated on the basis of the output voltage being supplied to the oscillator.

* * * * *